US005819148A

United States Patent [19]

Kromm, Jr. et al.

[11] Patent Number: 5,819,148

[45] Date of Patent: Oct. 6, 1998

[54] RENEWABLE THIN FILM OIL METERING BLADE

[75] Inventors: Alvin D. Kromm, Jr.; Robert S. Pawlik, both of Webster; Tricia A. Bhattacharya, Rochester, all of N.Y.

[73] Assignee: Xerox Corporation, Stamford, Conn.

[21] Appl. No.: 961,079

[22] Filed: Oct. 30, 1997

[51] Int. Cl.[6] ..... G03G 15/20

[52] U.S. Cl. ..... 399/324; 118/DIG. 1; 399/325

[58] Field of Search ..... 399/324–326; 118/DIG. 1

[56] References Cited

U.S. PATENT DOCUMENTS

| | | | |
|---|---|---|---|
| 3,996,887 | 12/1976 | Rengert | 399/324 |
| 4,011,831 | 3/1977 | Braun et al. | 399/324 |
| 4,426,953 | 1/1984 | Kromm, Jr. et al. | 118/68 |
| 5,049,944 | 9/1991 | DeBolt et al. . | |
| 5,145,525 | 9/1992 | Fromm et al. | 118/260 |
| 5,208,639 | 5/1993 | Thaver et al. . | |
| 5,272,509 | 12/1993 | Pitts et al. | 399/325 |
| 5,424,819 | 6/1995 | Menjo | 399/325 |
| 5,717,987 | 2/1998 | Fromm | 399/325 |

*Primary Examiner*—Matthew S. Smith

[57] ABSTRACT

A heat and pressure fuser and RAM system therefor. The RAM system includes a metering roll, thin film and a metering blade supported for effecting intimate contact between the metering roll and the thin film. The thin film is supported for movement from a supply reel to a take-up reel for periodic movement of a new portion of the film into contact with the metering roll. In this manner, contamination in the area of contact between the metering roll and the thin film is minimized. Moreover, the thin film which has a high surface tension, minimizes blade wear.

20 Claims, 2 Drawing Sheets

RENEWABLE THIN FILM OIL METERING BLADE

BACKGROUND OF THE INVENTION

This invention relates generally to heat and pressure fusers for an electrophotographic printing machines, and more particularly to a Release Agent Management (RAM) therefor.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to a donor roll is then deposited on a latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip.

The heated fuser roll is usually the roll that contacts the toner images on a substrate such as plain paper. In any event, the roll contacting the toner images is usually provided with an abhesive material for preventing toner offset to the fuser member. Three materials which are commonly used for such purposes are PFA™, Viton™ and silicone rubber. All of these materials, in order to maintain their abhesive qualities, require release agents specific to the material.

Various methods are known for applying release agent materials to a fuser member such as a heated fuser roll. One such system comprises a donor roll which contacts the fuser member to which the oil or release agent material is applied. The donor roll also contacts a metering roll which conveys the oil from a supply of oil to the donor roll. A blade member is provided metering oil on the metering roll. Such blade structures can meter oil non uniformly due to wear of the blade and dirt accumulation.

Color xerographic imaging requires better oil uniformity than conventional monochrome, black only xerography. Silicone oil used to insure proper release from the fuser roll can change the gloss of images on a substrate and the projection efficiency of transparencies. When the oil is not applied uniformly the color images exhibit noticeable streaks. An obvious solution to the problem of blade wear would be to replace the metering blade at periodic intervals while a solution to the accumulation of contaminants would be to periodically remove the contaminants. Such periodic maintenance can be costly and result in unnecessary down time of the imaging apparatus in which the RAM system is used.

It is desirable to eliminate the problem of blade contamination and wear as described above as well as the negative impact on productivity and expense associated therewith.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 4,426,953 granted to Kromm, Jr., et. al. on Jan. 24, 1984 discloses a heat and pressure roll fusing apparatus for fixing toner images to copy substrates. The apparatus includes a release agent management system (RAM) for applying release agent such as functional silicone oil to a heated roll of the apparatus. The RAM comprises a donor roll, a metering roll and a metering blade which cooperate to convey silicone oil from a sump to the surface of the heated roll. The metering roll which is contacted by the metering blade is provided with a helical groove which acts to scrape the tip of the metering blade as the metering roll rotates and move paper related residue dislodged therefrom to the end of the metering roll where it is collected for subsequent disposal.

U.S. Pat. No. 5,208,639 granted to Thayer, et. al on May 4, 1993 discloses an apparatus for cleaning residual toner and debris from a moving charge retentive surface of an image forming apparatus includes a multiple turret style blade holder located such that an individual blade is selectively indexed into optimum position for cleaning the moving photoreceptor. The blade holder contains a number of cleaning blades mounted radially from a central core and by rotating the holder about its longitudinal axis a specified number of degrees (360 deg./number of cleaning blades on the holder) a new cleaning blade is moved by the indexing device into the cleaning position to replace a failed blade. The indexing device removes the failed cleaning blade and positions a new cleaning blade in frictional contact with the photoreceptor for cleaning.

U. S. Pat. No. 5,049,944 granted to DeBolt, et. al. on Sep. 17, 1991 discloses an apparatus and method for applying offset preventing liquid to a fuser roll including an oil impregnated web member adapted to be moved by a motor from a supply core to a take up core; and a control to vary the duty cycle operation of the motor to drive the web member at a relatively constant linear speed at a contact nip, the control including a timer to monitor the cumulative time of operation of the motor and to progressively decrease the duty cycle of the motor in response to the cumulative time of operation wherein the progressively decreased duty cycle of operation compensates for the increasing radius of the web member on the take up core to maintain the relatively constant linear speed at the contact nip.

While the cited patents present solutions to the problem of contamination in the area of contact between a metering roll and a metering blade wear as well as the problem of blade wear there is room for improvement in these areas.

BRIEF SUMMARY OF THE INVENTION

According to the intents and purposes of the present invention, which are to provide a structure and method for uniformly metering oil in a RAM system as well as preventing the accumulation of contaminants for a heat and pressure fuser, there is provided a metering structure for a RAM system comprising a metering roll and a renewable oil metering surface supported in intimate contact with one edge of the metering roll.

The renewable oil metering surface also acts to remove contaminants from the surface of the metering roll. To these ends there is provided a metering blade and an elongated thin film, the latter of which is held in intimate contact with an edge of a metering blade which is supported such that the thin film contacts the surface of the metering roll rather than the edge of the metering blade making direct contact with the metering member. In other words, the thin film is disposed between the blade edge and the surface of the metering roll.

The thin film is supported for transport between supply and take-up reels so that the surface of the thin film that contacts the metering roll can be periodically renewed by incrementally transporting the thin film from one of the two reels to the other.

DESCRIPTION OF THE PREFERRED EMBODIMENT(S) OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 2:
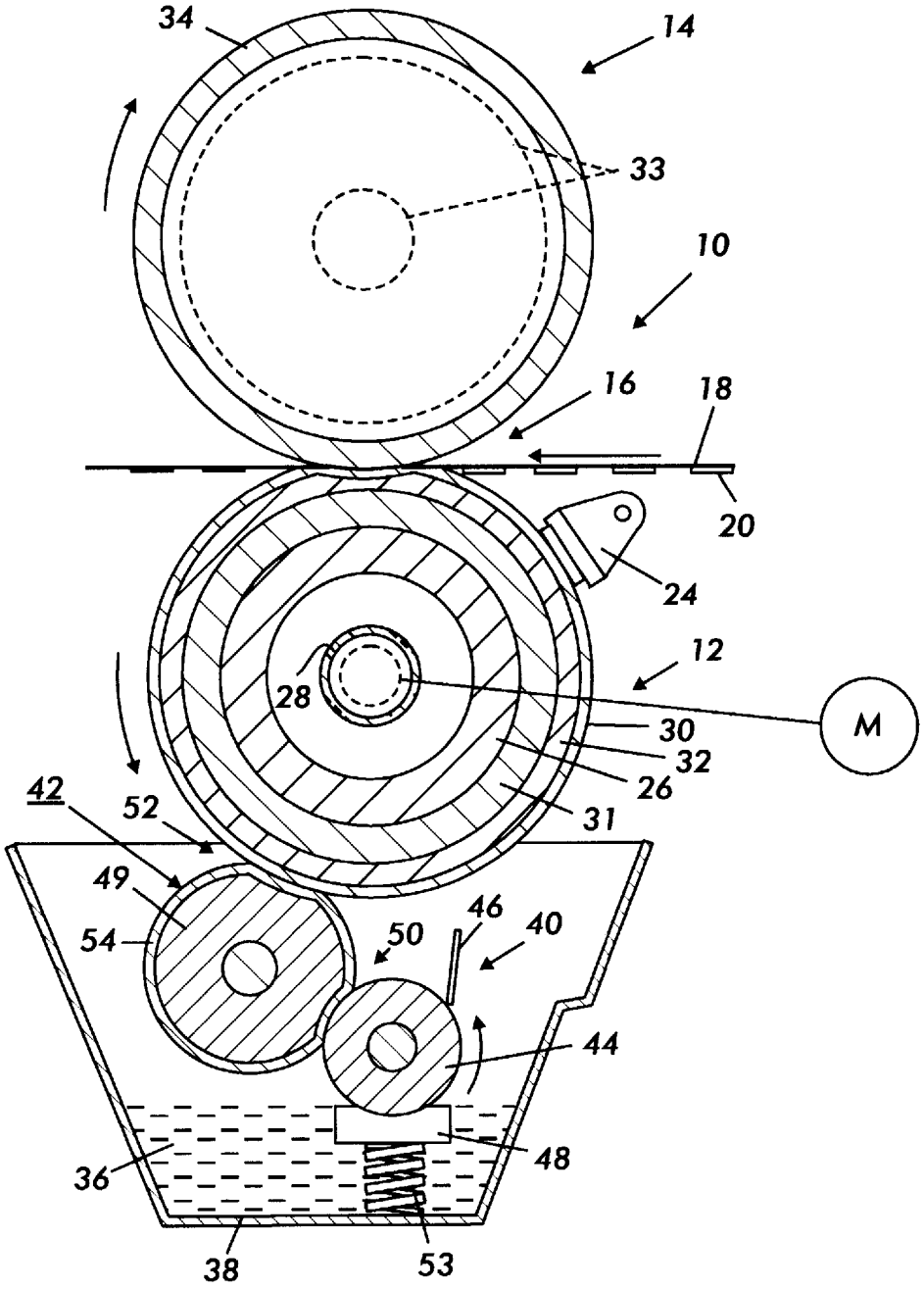
FIG. 2 PRIOR ART
FIG. 2 is a schematic representation of a heat and pressure fuser and RAM therefor according to the prior art.

For a general understanding of the features of the present invention, reference is made to the drawings. In the drawings, like reference numerals have been used throughout to identify identical elements. FIG. 2 discloses a multi-layered Nip Forming Fuser Roll (NFFR) fuser structure generally indicated by reference character 10. The fuser apparatus comprises a heated roll structure 12 cooperating with a non-heated backup roll structure 14 to form a nip 16 through which a copy substrate 18 passes with toner images 20 formed thereon in a well known manner. The toner images 20 contact the heated roll structure while a force is applied between the roll structures in a well known manner to create pressure therebetween resulting in the deformation of the heated fuser roll structure by the nonheated pressure roll structure to thereby form the nip 16.

As the substrate passes out of the nip, substrates generally are self stripping except for very light weight ones. These substrates require a guide to lead them away from the fuser roll. After separating from the fuser roll, substrates are free to move along a predetermined path toward the exit of the machine (not shown) in which the fuser apparatus 10 is to be utilized.

A contact temperature sensor 24 is provided for sensing the surface temperature of the roll structure 12 and in conjunction with conventional circuitry (not shown) maintains the surface temperature to a predetermined value, for example, on the order of 375°–400° F. The heated roll structure 12 comprises a core or hollow cylinder or core 26 having a radiant quartz heater 28 disposed in the hollow thereof. When suitably energized via the aforementioned circuitry, the heating element radiates heat to the cylinder which is then conducted to the outer surface. The fuser roll is constructed of multiple layers. The first layer attached to the core is generally a conductive silicone rubber having a conductivity in the order of 0.4 to 0.7 w/m°C. In order to prevent penetration of silicone oil into the base layer, two layers of Viton are used. First layer of 40 $\mu$m of Viton is a thermally conductive Viton in the order of 0.25 to 0.4 w/m°C. The outer 10 $\mu$m Viton is relatively non-conductive, smooth-surfaced outer layer 30 of the structure 12. Pursuant to the intents and purposes of the invention, the layer 30 preferably comprises Viton™ (trademark of E.I. du Pont Nemours & Co. for a fluoroelastomer based on the copolymer of vinylidene fluoride and hexafluoropropylene) which is relatively thin, having a thickness of about 10 $\mu$ (FIG. 2). The conductivity of the outer layer is about 0.17 w/m°C.

A base layer 31 which is adhered to the core 26 comprises a relatively thick layer of conductive silicone rubber. A typical thickness for inner layer 31 is in the order of 1–3 mm, the conductivity thereof being in the order of 0.5–0.8 w/m°C. The conductivity of the base member is effected in a conventional manner by adding conductive materials to the silicone rubber. The conductive silicone rubber layer retains sufficient deformability to be used in a NFFR structure notwithstanding the presence of the conductive material.

An inner layer 32 adhered to both the outer layer 30 and inner layer 31 has an intermediate thickness of about 40 $\mu$m and like the outer layer 30 is fabricated from Viton™. However, unlike the outer layer 30, the inner layer 32 is rendered thermally conductive using appropriate metallic and/or non-metallic fillers well known in the art to provide a conductivity in the order of 0.25–0.4 w/m°C. The layers of Viton™ and silicone rubber and fabricated and are adhered to each other by various techniques known in the prior art. For example, the Viton™ layers may be formed by spraying or flow coating while the silicone rubber layer may be molded. The base layer with the outer and inner layers adhered thereto is adhered to the core 26 in any suitable manner. Viton™ is rendered abhesive by the use of appropriate functional silicone oils such as Mercapto or amino oils.

The Viton™ outer layer 30 together with the inner Viton layer 32 form a barrier layer between the layer 31 and a substrate carrying toner images for preventing oil penetration into the base layer while allowing adequate heat flow therethrough thereby enabling said NFFR to be utilized for high speed fusing of color toner images.

The outer and inner layers 30 and 32 exhibit good release, durability and produce high gloss toner images with only a minimal impedance to heat dissipation compared to prior art devices. The inner conductive layer 32 and the base layer 31 provide for excellent transfer of thermal energy from the heat source 28.

Because of the low thermal impedance of the combination of layers 30 and 32, a machine in which fuser is utilized can be operated at a speed of approximately 50% faster than without the fuser structure disclosed herein. In other words, the machine for which the instant NFFR is provided can operate at 100 pages per minute (ppm) instead of 70 ppm. The increase in speed is attained without sacrificing toner release, durability or image gloss properties.

The backup roll structure 14 comprises a metal core 33 to which is adhered a relatively thin layer 34 of a suitable abhesive material. The layer 34 may be provided with a sleeve of suitable material (not shown). Due to the relative constructions of the fuser roll structure 12 and pressure roll structure 14, the fuser roll is deformed by the harder pressure roll structure when the required pressure is applied therebetween, the pressure being a function of the desired deformation which corresponds to the desired length of the nip 16.

While the outer layer 30 is not adequately abhesive, it has been found desirable to coat this layer with a release agent material 36 contained in a sump 38. The material 36 comprises a polymeric release agent material such as mercapto or amino silicone oil.

For the purpose of coating the heated roll structure 12 there is provided a Release Agent Management (RAM) system generally indicated by reference character 40. The mechanism 40 comprises a donor roll 42, metering roll 44, doctor blade 46 and a wick 48. The metering roll 44 is partially immersed in the release agent material 36 and is supported for rotation such that it is contacted by the donor roll 42 which, in turn, is supported so as to be contacted by the heated roll structure 12. As can be seen, the orientation of the rolls 42 and 44 is such as to provide a path for conveying material 36 from the sump to the surface of the heated roll structure 12. The metering roll is preferably a nickel or chrome plated steel roll having a 4-32 AA finish. The metering roll has an outside diameter of 1.0 inch. As mentioned above, the metering roll is supported for rotation, such rotation being derived by means of the positively driven heated roll structure 12 via the rotatably supported donor roll 42. In order to permit rotation of (at a practical input torque to the heated roll structure 12) the metering roll 44 in this manner the donor roll 42 comprises a deformable layer 49 which forms a first nip 50 between the metering roll and the donor roll and a second nip 52 between the latter and the heated roll. The nips 50 and 52 also permit satisfactory release agent transfer between the rolls and roll structure. Suitable nip lengths are about 0.10 inch.

Wick 48 is fully immersed in the release agent and contacts the surface of the metering roll 44. The purpose of the wick is to provide an air seal which disturbs the air layer formed at the surface of the roll 44 during rotation thereof. If it were not for the function of the wick, the air layer would be coextensive with the surface of the roll immersed in the release agent thereby precluding contact between the metering roll and the release agent. A bias member 53 urges the wick 48 into contact with the metering roll.

The wiper blade 46 preferably fabricated from Viton is ¾×⅛ in cross section and has a length coextensive with the metering roll. The edge of the blade contacting the metering roll has a radius of 0.001–0.010 inch. The blade functions to meter the release agent picked up by the roll 44 to a predetermined thickness, such thickness being of such a magnitude as to result in several microliters of release agent consumption per copy. The donor roll 42 has an outside diameter of 1.0 inch when the metering roll's outside diameter equals 1.0 inch. It will be appreciated that other dimensional combinations will yield satisfactory results. For example, 1.5 inch diameter rolls for the donor and metering rolls have been employed. The deformable layer 49 of the donor roll preferably comprises overcoated silicone rubber. However, other materials may also be employed.

A thin sleeve 54 on the order of several mils, constitutes the outermost surface of the roll 42, the sleeve material comprises Teflon, Viton or any other material that will impede penetration of silicone oil into the silicone rubber. While the donor rolls may be employed without the sleeve 54, it has been found that when the sleeve is utilized, the integrity of the donor roll is retained over a longer period and contaminants such as lint on the heated roll 12 will not readily transfer to the metering roll 44. Accordingly, the material in the sump will not become contaminated by such contaminants.

Figure 1:
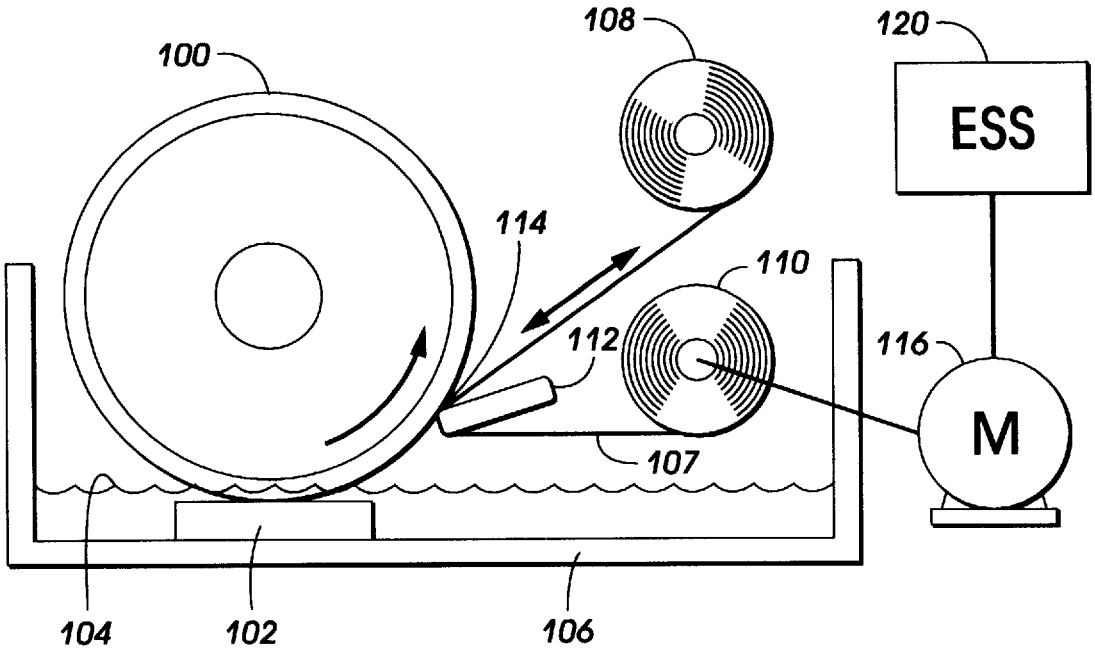
FIG. 1 is a schematic representation of a release agent metering system according to the invention.

An oil metering system according to the present invention, as shown in FIG. 1, comprises a metering roll 100 supported for contact with a wick 102 and a supply of silicone oil 104 which are contained in a sump 106. A web-like member of thin film 107 supported for movement between a supply reel 108 and a take-up reel 110 is forced into contact with the surface of the metering roll 100 by means of a rubber metering blade 112. To this end the thin film is held in intimate engagement with an edge 114 of the blade.

In operation, a portion of the thin film 106 is incrementally transported from the supply reel 108 and the take-up reel 110 on a periodic basis in order to present a clean area of the thin film to the area of contact with the metering roll 100. In this manner, the metering surface provided by the combination of the blade and the thin film is renewed. A take-up motor 116 is provided for rotating the take-up reel 110 for effecting renewal of the metering surface. Operation of the take-up motor 116 is automatically controlled by an Electronic SubSystem (ESS) 120 which also serves to control other functions of the machine in which the fuser of the present invention is utilized. The movement of the thin film or web between the supply and take-up reels may be controlled in a manner similar to that described in the '944 patent. While the metering roll 100 may be rotated in either the clockwise or counterclockwise direction via a motor 118 its direction of rotation is determined by the direction of movement of the thin film which can be moved in either direction. As an illustrative example, the metering roll is rotated in a counterclockwise direction and the take-up reel 110 is also rotated in the counterclockwise direction. Thus, the contaminants trapped adjacent the interface between the thin film and the metering roll are moved away from this interface without having to retract the metering blade and thin film for such purposes.

The radius of the edge of the metering blade is in the order of 0.003 to 0.015 inches while the thin film thickness is in the order of 0.001 to 0.003 inches. The thin film 107 is fabricated from an abhesive material such as polytetrafluoroethylene known as Teflon™ or a polyimide material having a high surface energy.

As may now be appreciated in view of the invention described hereinabove, periodic renewal of the thin film metering surface in combination with a metering blade prevents contaminants from building up at the interface between the metering roll and the thin film. To this end, the thin film intimately contacts an edge of the metering blade and the blade is supported such that the that edge and film are oriented such that a chiseling action is effected. The use of the thin film also reduces wear of the metering blade because it precludes direct contact with the metering roll surface. Both of these aspects of the present invention provide for more uniform metering of the silicone oil onto the metering roll than prior art devices which use only the metering blade without the thin film of the present invention.

We claim:

1. A release agent management structure, said structure comprising:

a donor member;

a metering member contacting said donor member and a supply of release agent material for conveying release agent material from the latter to the former;

an oil distributing structure including:

a metering blade supported at an angle relative to said metering member;

a renewable surface member contacting said metering member and said metering blade and cooperating with said metering blade for distributing release agent material over the surface of said metering member and removing contaminants tending to accumulate between it and said metering member.

2. Structure according to claim 1 wherein said renewable surface member comprises an elongated member.

3. Structure according to claim 2 wherein said renewable surface member comprises a thin film.

4. Structure according to claim 3 wherein said thin film is supported in intimate contact with an edge of said metering blade.

5. Structure according to claim 4 wherein said metering blade is supported such that said thin film and said edge cooperate to effect a chiseling action for distributing said release agent material and for removing contaminants from said metering member.

6. Structure according to claim 5 wherein said thin film has a thickness in the order of 0.001 to 0.003 inches.

7. Structure according to claim 6 wherein said thin film is fabricated from a polyimide material.

8. Structure according to claim 7 wherein said donor and metering members comprise rolls.

9. Structure according to claim 6 wherein said thin film is fabricated from polytetrafluoroethylene.

10. Structure according to claim 9 wherein said release agent material comprises silicone oil.

11. Heat and pressure fuser apparatus, said fuser comprising:

a heated fuser member;

a donor member contacting said heated fuser member;

a metering member contacting said donor member and a supply of release agent material for conveying release agent material from the latter to the former;

an oil distributing structure including:

a metering blade supported at an angle relative to said metering member;

a renewable surface member contacting said metering member and said metering blade and cooperating with said metering blade for distributing release agent material over the surface thereof and removing contaminants tending to accumulate between it and said metering member.

12. Apparatus according to claim 11 wherein said renewable surface member comprises an elongated member.

13. Apparatus according to claim 12 wherein said renewable surface member comprises a thin film.

14. Apparatus according to claim 13 wherein said thin film is supported in intimate contact with an edge of said metering blade.

15. Apparatus according to claim 14 wherein said metering blade is supported such that said thin film and said edge cooperate to effect a chiseling action for distributing said release agent material and for removing contaminants from said metering member.

16. Apparatus according to claim 15 wherein said thin film has a thickness in the order of 0.001 to 0.003 inches.

17. Apparatus according to claim 16 wherein said thin film is fabricated from a polyimide material.

18. Apparatus according to claim 17 wherein said release agent material comprises silicone oil.

19. Apparatus according to claim 16 wherein said thin film is fabricated from polytetrafluoroethylene.

20. Apparatus according to claim 19 wherein said donor and metering members comprise rolls.

* * * * *